United States Patent [19]

Macaluso

[11] Patent Number: 5,012,891

[45] Date of Patent: May 7, 1991

[54] MUFFLER ASSEMBLY

[75] Inventor: Howard C. Macaluso, Jackson, Mich.

[73] Assignee: Tennessee Gas Pipeline Company, Lincolnshire, Ill.

[21] Appl. No.: 310,583

[22] Filed: Feb. 15, 1989

[51] Int. Cl.[5] ..... F01N 7/18

[52] U.S. Cl. ..... 181/282

[58] Field of Search ..... 181/228, 239, 241, 243, 181/250, 268, 272, 273, 282

[56] References Cited

U.S. PATENT DOCUMENTS

| | | | |
|---|---|---|---|
| 4,635,752 | 1/1987 | Jennings | 181/282 X |
| 4,700,806 | 10/1987 | Harwood | 181/282 |
| 4,735,283 | 4/1988 | Macaluso | 181/272 X |
| 4,736,817 | 4/1988 | Harwood | 181/282 |
| 4,759,423 | 7/1988 | Harwood et al. | 181/282 |
| 4,765,437 | 8/1988 | Harwood et al. | 181/282 |

*Primary Examiner*—Brian W. Brown

*Attorney, Agent, or Firm*—Harness, Dickey & Pierce

[57] ABSTRACT

An exhaust gas muffler has a housing composed of upper and lower press-formed parts with two chambers and a gas passage means composed of upper and lower plates with three parallel press-formed troughs defining a tri-flow gas path wherein one of said chambers serves as a turn-around from the gas path and the other of said chambers receives said troughs and is acoustically connected to the gas path through perforations in the walls of the troughs.

10 Claims, 3 Drawing Sheets

FIG 2
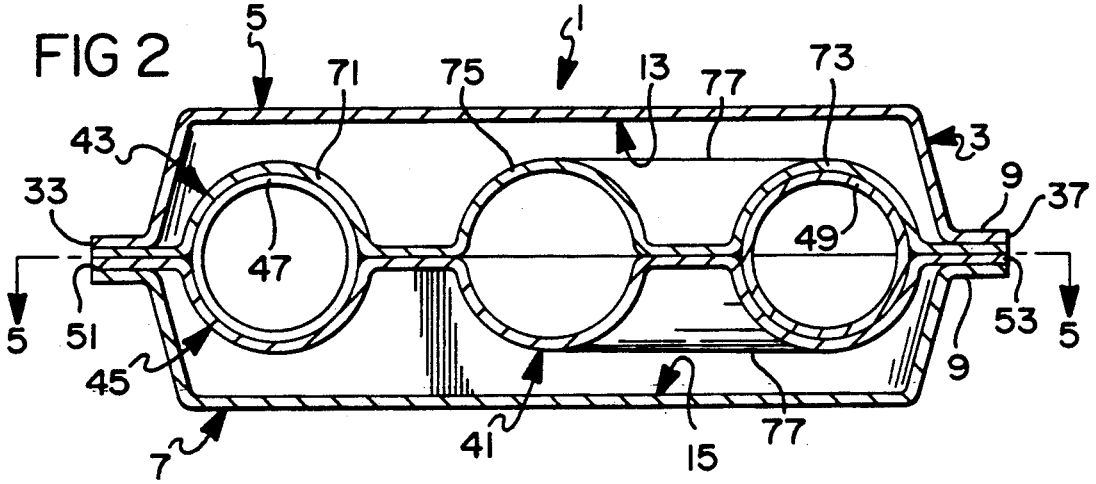
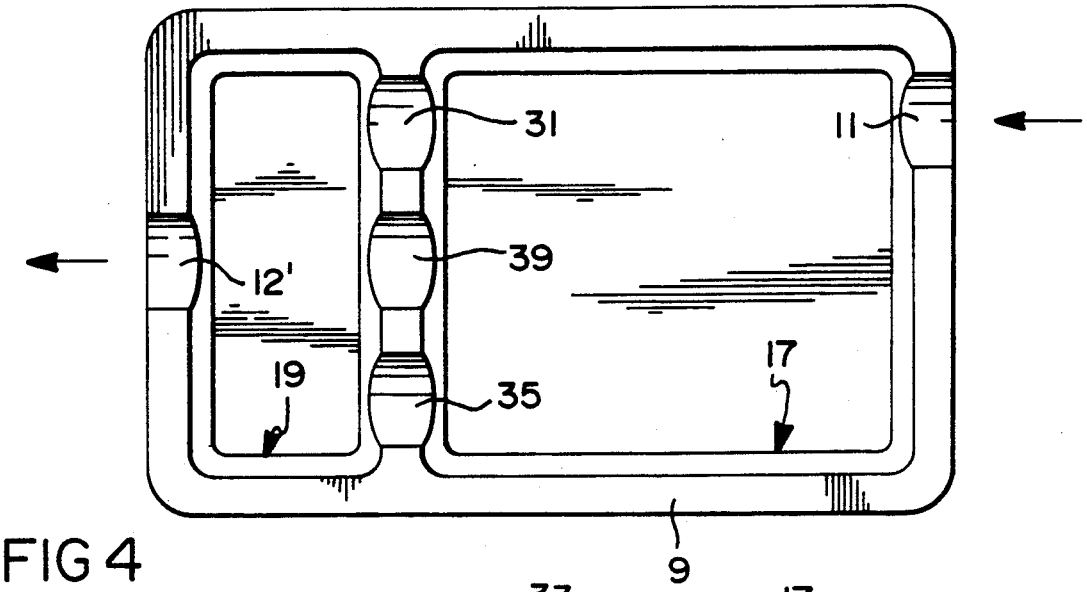
FIG 4
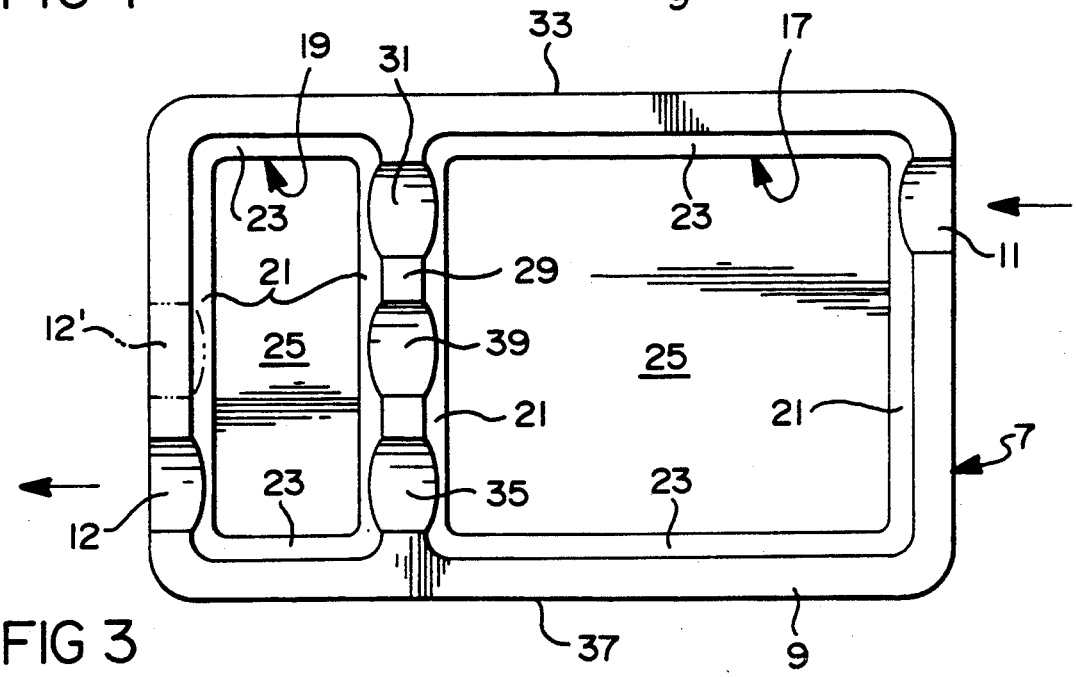
FIG 3

FIG 7
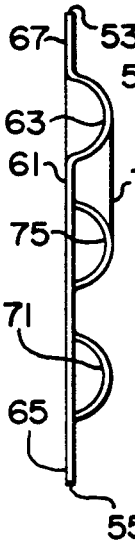
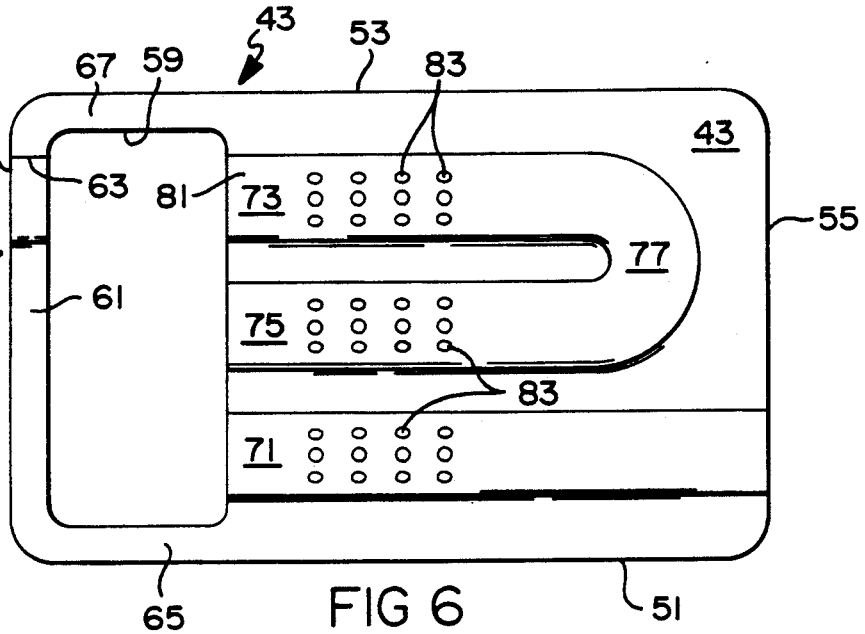
FIG 6
FIG 9
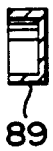
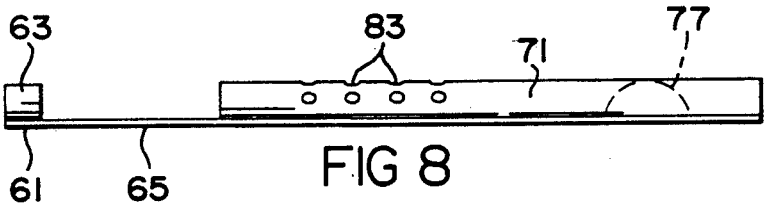
FIG 8
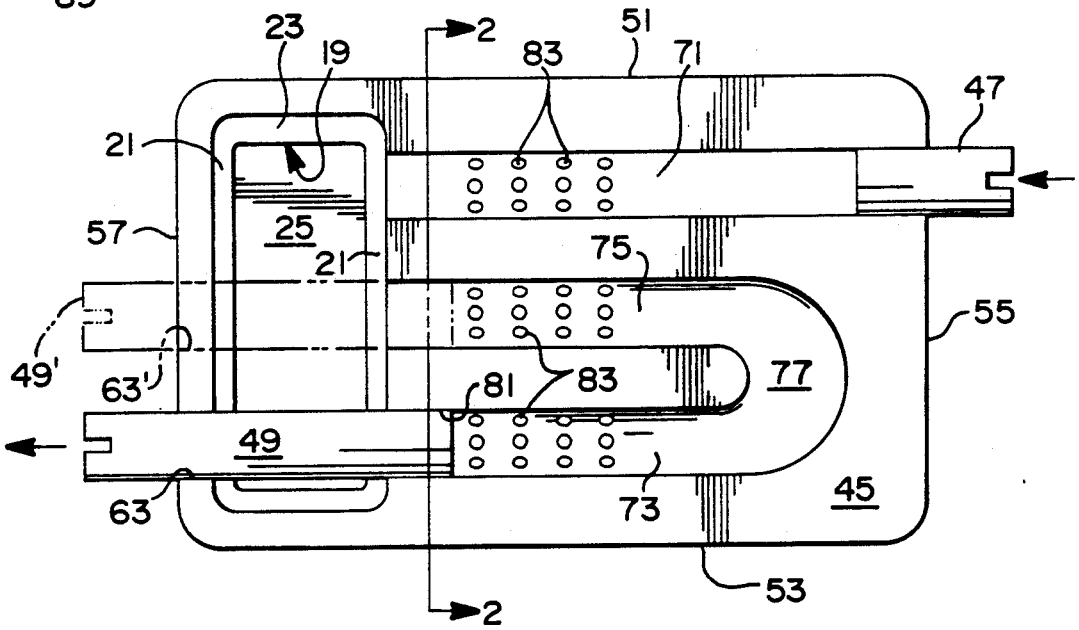
FIG 5

MUFFLER ASSEMBLY

This invention relates to sound attenuating mufflers for use in exhaust gas systems of automobiles and trucks.

It is the purpose of this invention to provide a high performance type muffler composed of press-formed metal parts.

Another purpose of the invention is to provide a muffler composed of press-formed metal parts with a design that enables it to be easily adapted for use in either a "side-in/side-out" or a "side-in/center-out" installation.

BRIEF SUMMARY OF THE INVENTION

A muffler according to the invention has a housing composed of upper and lower housing halves which are produced by the press-forming of recesses and curved portions in each of two flat metal blanks. The muffler also has a gas flow passage means composed of upper and lower flat metal plates adapted to fit between the upper and lower housing sections in which the gas flow passage is produced by the press-forming of troughs in the plates which combine with each other when the plates are assembled to provide a high performance tri-flow pattern of gas flow for the muffler. The troughs fit in curved portions in the upper and lower housing halves; and additional interfitted curved portions in opposite ends of the plates and housing halves serve as gas flow ports that receive tubular inlet and outlet bushings for connection to exhaust and tail pipes in exhaust systems. The gas passage plates have large openings that are aligned with one set of recesses in the upper and lower housings and these provide a turn-around chamber in the tri-flow pattern of gas flow, this pattern and chamber being designed to allow either one of two gas flow passage sections to be used as the outlet gas flow section. Thus, the outlet bushing may be connected to a side gas flow section if a side outlet to the muffler is desired or it may be connected to a center section if a center outlet is desired.

DESCRIPTION OF THE DRAWINGS

FIG. 2 is a transverse, vertical cross section of the muffler of FIG. 1 after the parts have been assembled together and is taken at the position, represented by line 2—2 of FIG. 5.

FIG. 3 is a plan view looking at the inside of the lower half of the housing used in the muffler of FIGS. 1 and 2 wherein the flow is side in and side out;

FIG. 4 is a plan view looking at the inside of the lower half of an alternate form of the housing used in the muffler of FIGS. 1 and 2 wherein the flow is side in to center out;

FIG. 5 is a longitudinal horizontal cross section (with parts omitted) of the muffler as taken at a position represented by line 5—5 of FIG. 2 and with the upper plate omitted.

FIG. 6 is a plan view showing the bottom of the lower gas passage forming plate used in the muffler, the bottom plate being a mirror image of the top plate;

FIG. 7 is a left side elevation of the plan view shown in FIG. 6; and

FIG. 8 is a front elevation of the plan view shown in FIG. 6; and

FIG. 9 is a cross section through a round, cup-shaped plug for blocking an outlet port

DETAILED DESCRIPTION OF A PREFERRED EMBODIMENT OF THE INVENTION

Figure 1:
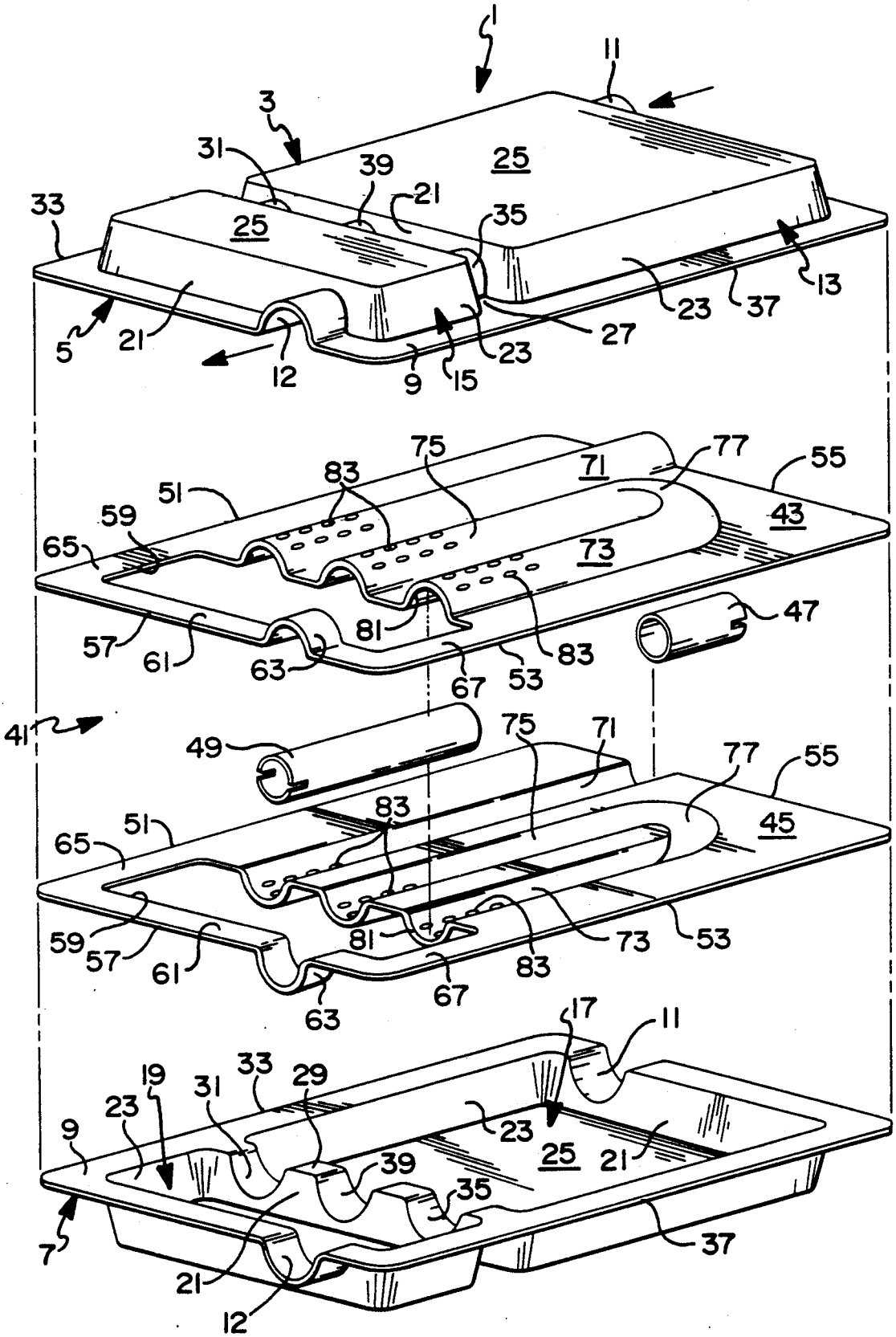
FIG. 1 is an exploded view of a muffler embodying the invention.

An automotive exhaust system muffler 1 has an outer housing or shell 3 comprising upper and lower pan-shaped halves 5 and 7, respectively, which are substantially mirror images of each other. The halves are stamped or power press formed from flat strips or sheets of metal, ordinarily low carbon steel or stainless steel. Each half is substantially rectangular in plan view and has an outer flange 9 around all four sides which is flat except for curved gas port forming portions 11 and 12 at opposite ends. The flat outer flange 9 remains from the flat metal blank in which the final shape of the half 5 or 7 is formed. This shape includes a plurality of drawn, pan-shaped rectangular cups or recesses. Two such recesses are shown to have been pressed into each of the top and bottom halves. The top half 5 has recesses 13 and 15 and the bottom half 7 has the recesses 17 and 19 which are vertically aligned respectively with the recesses 13 and 15. Each recess has pairs of transverse sidewalls 21 and longitudinally extending sidewalls 23, all tapered to facilitate stamping, as well as bottom walls 25. As will be apparent hereinafter, the two recesses 13 and 17 perform a sound attenuation function while the two recesses 15 and 19 perform a gas flow turn-around function as well as a sound attenuation function.

The two recesses in each half 5 and 7 are separated by a substantially flat divider section which extends transversely across the width of the half to join the flat outer flange 9. Except for curved portions formed in it, each of these flat sections is coplanar with the flange 9 in its half. In the top half 5, section 27 separates recesses 13 and 15. In the bottom half 7, section 29 separates recesses 17 and 19. Upper section 27 is vertically aligned with lower section 29.

The divider sections 27 and 29 have curved portions, preferably semi-cylindrical, pressed in them to connect adjacent recesses. From the outside of the muffler 1, these curved portions have the appearance of channels. Upper and lower halves 5 and 7 have vertically aligned curved portions 31 in sections 27 and 29 which are coaxial with curved gas portion 11 and located adjacent the longitudinal side 33 of the housing 3. They also have vertically aligned curved portions 35 in sections 27 and 29 which are coaxial with gas port portion 12 and located adjacent the other longitudinal side 37 of the housing 3. In addition they have vertically aligned curved portions 39 in sections 27 and 29 which are located approximately midway between the two sides 33 and 37 of the housing 3, i.e., on or close to the longitudinal center line of the housing.

Gas passage means 41 provides a path for gas to flow between ports 11 and 12. This means includes upper and lower substantially flat plates 43 and 45, respectively, as well as a bushing 47 that fits in upper and lower curved portions 11 of the halves 5 and 7 and a somewhat longer bushing 49 that fits in upper and lower curved portions 12 of the halves 5 and 7.

The upper and lower plates 43 and 45 are substantially mirror images of each other and are of substantially the same area as the upper and lower housing halves 5 and 7. They, therefore, can fit between the flanges 9 of the halves 5 and 7 and be clamped together and to the halves in a gas tight manner at assembly of the muffler, as seen in FIG. 2. The plates 43 and 45 have longitudinal side edges 51 and 53 corresponding to longitudinal side edges 33 and 37 of the housing 3. They also have transverse end edges 55 and 57 extending between the side edges 51 and 53.

The upper and lower plates 43 and 45 are power press formed in flat strips of metal, such as carbon steel or stainless steel. In the stamping or press forming operation each has a rectangular opening 59 sheared out of it adjacent the end edge 57. The openings 59 are substantially the same size as recesses 15 and 19 in upper and lower housing halves 5 and 7 and are in vertical alignment with them when the parts are clamped together at assembly. The openings 59 are spaced from the end edges 57 by a narrow, transverse band of metal 61 corresponding to the rim 9 of the halves 5 and 7. The band 61 is flat except for curved gas port portions 63 which are sized and located to fit inside of curved gas port portions 12 of the housing when the parts are assembled. The openings 59 are also spaced from longitudinal side edges 51 and 53 by narrow, longitudinal bands of metal 65 and 67, respectively, that also correspond to the rim 9 of the halves 5 and 7.

The upper and lower plates 43 and 45 each have a first straight trough 71, preferably semi-circular in cross section, pressed in it adjacent longitudinal edge 51 to extend from transverse edge 55 to the opening 59. Troughs 71 are located to fit in curved portions 31 of the housing 3 when the parts are assembled as well as in the curved gas port portions 11.

The upper and lower plates 43 and 45 also each have a second straight trough 73, preferably semi-circular in cross section, pressed in it adjacent longitudinal edge 53 to extend from opening 59 toward transverse edge 55 but ending before it reaches that edge. Troughs 73 are located to fit in curved portions 35 of the housings 3 and 7 when the parts are assembled and are parallel to trough 71.

In addition, the upper and lower plates 43 and 45 each have a third straight trough 75, preferably semi-circular in cross section, pressed in it on or adjacent the center line of the plate to extend parallel to trough 71 and 73 from opening 59 toward tranverse edge 55 but ending before it reaches that edge. Troughs 75 are located to fit in curved portions 39 of the housing 3 when the parts are assembled.

Finally, the upper and lower plates 43 and 45 have a fourth and U-shaped trough 77, preferably semi-circular in cross section, pressed in it adjacent edge 55 and connecting the adjacent ends of troughs 73 and 75.

When the parts are assembled, the end of each trough 71 adjacent edges 55 fits in a curved portion 11 of the housing 3. Fitted inside of troughs 71 and securely fastened in a gas tight manner, as by welding to the plates and/or the housing, is the inner end of gas flow bushing 47. At the other end of the muffler, the longer gas flow bushing 49 fits in the curved plate portions 63 and extends across the recesses 15 and 19 into the aligned end portions 81 of troughs 73. The bushing 49 is securely fastened in a gas tight manner by welding or the like to the plates and/or the housing.

When the plates 43 and 45 are face to face in assembled condition, the troughs combine to form tubular gas passages located almost entirely in recess 13 of the upper housing half 5 and recess 17 of the lower housing half 7. Perforations or louvers 83 press formed in the walls of the troughs 71, 73, and 75 (and 77, if desired) provide for communication between the gas flowing through the gas passages provided by the troughs and the chambers provided by recesses 13 and 17.

The muffler 1 is installed in an exhaust gas silencing system for fuel combustion engines by tightly clamping or welding the inlet bushing 47 to the exhaust pipe (not shown) of the system and tightly clamping or welding the outlet bushing 49 to the tail pipe (not shown) of the system. The particular positions of the exhaust pipe and the tail pipe are determined by the designers of the vehicle and its exhaust system. The muffler shown in FIGS. 1–3 and 5–8 has a "side-in/side-out" arrangement of the inlet and outlet bushings and accommodates a substantial transverse offset between the axes of the exhaust pipe and tail pipe. In this muffler, the inlet bushing 47 is adjacent one longitudinal side 33, 51 of the muffler while the outlet bushing 49 is adjacent the other longitudinal side 37, 53 of the muffler.

FIGS. 3–5, also illustrate a simple modification of the muffler wherein it has a "side-in/center-out" arrangement of the inlet and outlet bushings to accommodate a lesser transverse offset between the exhaust pipe and tailpipe. In this modification the curved portions 12' (FIG. 4) for the upper and lower housings 5 and 7 are located on the axis of the curved portions 39 and the passage provided by troughs 75. Also, in this modification the curved portions 63' (FIG. 5) in the upper and lower plates 43 and 45 are located to fit inside of curved portions 12' in the housing halves. Thus, as shown by phantom lines in FIG. 5, the outlet tube 49' can be mounted on the axis of the gas passage provided by troughs 75 which is adjacent or on the longitudinal centerline of the muffler.

While only one set of curved portions 12, 63 or 12', 63' is used in a particular muffler it may be desirable for reasons of economy in manufacture and flexibility in use to form both sets in all mufflers and to block one set off by means of a round, cup-shaped plug 89 (FIG. 9) which can be inserted into the unused portions 63 or 63' and welded in place. As will be seen, the arrangement of troughs 73, 75, and 77 and the gas passages that they provide make it possible to have this flexibility whereby the muffler construction can be readily used for a "side-in/side-out" application or a "side-in/center-out" application.

In operation as a "side-in/side-out" muffler, exhaust gas enters the muffler through the inlet bushing 47 and flows down an inlet gas passage section provided by troughs 71 to empty into the turn-around chamber provided by recesses 15 and 19 of the upper and lower housing halves 3 and 5. The gas reverses direction in this chamber and enters a return flow gas passage section provided by troughs 75. It then reverses direction in U-shaped turn-around troughs 77 to enter the outlet gas passage section provided by troughs 73 and flow into outlet bushing 49, across the chamber provided by recesses 15 and 19, and out of the muffler into a tail pipe (not shown).

In operation as a "side-in/center-out" muffler, the outlet tube 49 is omitted and outlet tube 49' connected to the troughs 75 is used. If the muffler has both sets 12, 63 and 12', 63' of curved portions, the plug 89 is inserted into curved portions 63 to block the side outlet port for the muffler. With this arrangement, exhaust gas enters the muffler through inlet bushing 47 and flows down an inlet gas passage section provided by troughs 71 to empty into the chamber provided by recesses 15 and 19. The gas reverses direction in this chamber and enters a return flow gas passage section provided this time by the troughs 73. It then reverses direction in U-shaped turn-around troughs 77 to enter an outlet gas flow passage section provided this time by the center troughs 75. It flows down this section to the center located outlet tube 49' and out of the muffler into a tail pipe (not shown).

Gas flowing through the tri-flow gas flow passage in the muffler is subjected to various means for absorbing acoustic energy and reducing sound and noise in the gas. The perforations or louvers 83 connect the gas in each gas flow section with the recesses 13 and 17 in the upper and lower housing halves 5 and 7. This provides a mechanism to attenuate medium and high sound frequencies. The abrupt change in cross section of the gas flow path as the gas enters and leaves the chamber provided by recesses 15 and 19 and turbulence within the chamber removes substantial energy from the gas and tends to attenuate a wide range of sound frequencies. The muffler does not have a Helmholtz tuning mechanism or an equivalent means for attenuating specific low frequencies as it is intended to allow the low frequency power sound, desired by performance car drivers, to remain in the exhaust system. High performance is enhanced in a small tri-flow type muffler by the smooth, low-resistance gas flow passage through the muffler. For the replacement market, the design of the muffler is such that the bushings 47, 49, or 49' can be inserted into and welded to the muffler at the time that it is installed on a vehicle. This enables the muffler without bushings to be packaged, shipped, and stored at a reduced cost since it is substantially more compact in that condition. If the muffler is made with both sets 12, 62 and 12', 63' of curved portions, the after-market muffler shop need only inventory the one muffler since by using plug 89 along with bushings 47 and 49 or 49' it can make the muffler fit either the "side-in/side-out" or "the side-in/center-out" installation.

Modifications may be made in the specific structure shown without departing from the spirit and scope of the invention.

What is claimed is:

1. A sound attenuating exhaust gas muffler for a vehicle exhaust system comprising a housing formed of two pan-shaped halves, each of said pan-shaped halves having a recess which are operable to form a gas flow turn-around chamber, a plurality of gas flow plates disposed between said pan-shaped halves, said gas flow plates having troughs integrally press-formed therein defining a tri-flow gas flow passage, said troughs comprising three parallel gas flow sections including inlet and outlet flow sections and a return flow section and a turn-around section connecting the return flow section and either the inlet or outlet flow section, two of said parallel gas flow sections opening into said turn-around chamber, inlet gas port means connected to the inlet flow section, and outlet gas port means connected to the outlet gas flow section.

2. A muffler as set forth in claim 1 wherein said housing has a sound attenuation chamber therein, said troughs being perforated and the perforations opening into said sound attenuation chamber.

3. A muffler as set forth in claim 1 wherein said turn-around section connects the return flow section and the outlet flow section, said outlet flow section being disposed within said plates on a first side of said turn-around section, said outlet gas port means including curved portions in the housing in alignment with the outlet gas flow section but on an opposite side of said turn-around chamber from the outlet flow section, said outlet gas port means being adapted to include an outlet gas flow bushing extending from said curved portions across the turn-around chamber into said outlet gas flow section.

4. A muffler as set forth in claim 3 including a second outlet gas port means comprising second curved portions in the housing in alignment with the return gas flow section but on the opposite side of said turn-around chamber from the return flow section and adapted to receive and outlet gas flow bushing to extend from the second curved portions to the return gas flow section whereby the return flow section may instead be used as an outlet flow section and said outlet flow section instead be used as a return flow section, and plug means in the second curved portions to block gas flow through said second outlet gas port means.

5. A sound attenuating exhaust gas muffler for a vehicle exhaust system comprising a housing with upper and lower housing halves having recesses integrally press-formed therein and cooperating to form a gas flow turn-around chamber, upper and lower gas-flow passage plates fitting together and between the upper and lower housing halves, said plates having troughs press-formed integrally therein defining a tri-flow gas flow passage, said troughs comprising three parallel gas flow sections including inlet and outlet flow sections and a return flow section and a turn-around section connecting the return flow section and the outlet flow section, two of said parallel gas flow sections opening into said turn-around chamber, curved portions in the halves and plates forming inlet and outlet gas flow ports, the outlet gas flow ports being located directly across the turn-around chamber from the outlet gas flow section whereby an outlet gas flow bushing may be positioned inside of the gas flow port to extend across the turn-around chamber into the end of the outlet gas flow section opening into the turn-around chamber, said inlet gas flow port being connected to said inlet gas flow section.

6. A muffler as set forth in claim 5 wherein said plates have openings therethrough aligned with each other and with the recesses in the housing halves forming said turn-around chamber.

7. A muffler as set forth in claim 6 wherein said upper and lower housing halves have sound attenuation recesses integrally press formed therein and aligned with said troughs in the plates, said plates having openings in the troughs connecting the insides of the troughs to said sound attenuation recesses.

8. A muffler as set forth in claim 7 including second curved portions in the halves and the plates forming a second outlet gas flow port, said second outlet gas flow port being located directly across the turn-around chamber from the return flow section whereby an outlet gas flow bushing may be positioned inside of the second outlet gas flow port to extend across the turn-around chamber into the end of the return gas flow section whereby said return gas flow section may be used as an outlet gas flow section in place of said first mentioned outlet gas flow section.

9. A muffler as set forth in claim 7 wherein said upper housing half has a sound attenuation recess extending across the width of the muffler whereby all three parallel gas flow sections are in said upper half recess, all three of said parallel gas flow sections being perforated in portions thereof to open into said upper half recess.

10. A muffler as set forth in claim 9 wherein said lower housing half has a sound attenuation recess extending across the width of the muffler whereby all three parallel gas flow sections are in said lower half recess, all three of said parallel gas flow sections being perforated in portions thereof to open into said lower half recess.

* * * * *